United States Patent [19]

Pries et al.

[11] 4,141,797

[45] Feb. 27, 1979

[54] METHOD OF OPERATING A BATTERY OF COKE OVENS

[75] Inventors: Erich Pries; Folkard Wackerbarth, both of Bochum, Fed. Rep. of Germany

[73] Assignee: Dr. C. Otto & Comp. G.m.b.H, Bochum, Fed. Rep. of Germany

[21] Appl. No.: 748,945

[22] Filed: Dec. 9, 1976

[30] Foreign Application Priority Data

Dec. 11, 1975 [DE] Fed. Rep. of Germany ..... 2555692
Feb. 9, 1976 [DE] Fed. Rep. of Germany ..... 2604937

[51] Int. Cl.[2] ..... C10B 23/00; F23N 1/00

[52] U.S. Cl. ..... 201/41; 202/141; 202/151; 432/28; 432/39

[58] Field of Search ..... 201/41; 432/28, 39, 432/52; 202/141, 142, 143, 144, 151

[56] References Cited

U.S. PATENT DOCUMENTS

| | | | |
|---|---|---|---|
| 3,527,445 | 9/1970 | Stewart, Jr. et al. | 432/28 |
| 3,875,016 | 4/1975 | Schmidt-Balve et al. | 201/41 |
| 4,039,391 | 8/1977 | Gensler | 202/142 |

*Primary Examiner*—Morris O. Wolk
*Assistant Examiner*—Roger F. Phillips
*Attorney, Agent, or Firm*—Thomas H. Murray; Clifford A. Poff

[57] ABSTRACT

The operation of a battery of coke ovens with regenerative change of draught on heating flues includes adjustably controlling the combustion of gases in the heating flues to insure uniform vertical heating of the coking coal in the coke oven chambers. Control elements for the operation of discrete heating flues in each heating wall are adjusted to insure uniform heating of the coking coal along the length of the heating walls. A gas supply rate is selected for the delivery of gas into the heating flues to define a carbonizing time corresponding to a high output capacity of coke from the coke oven battery. The heat consumption by the coking coal in the coke oven chambers is reduced during each regenerative half period by interruptions to the supply of gas at the gas supply rate without modifying or adjusting the control elements employed to insure uniform heat distribution in the heating flues. The method may further include delivering gas into the heating flues at a greater supply rate than a gas supply rate at which combustion throughout non-interrupted regenerative periods will yield sufficient heat to achieve the high output capacity of coke. When this greater supply rate of gas is selected, the interruptions to the supply of gas are carried out to insure carbonizing the coking coal in the oven chambers within the carbonizing time corresponding to a high output capacity of coke from the battery. To interrupt the gas supply, gas supply valves are closed. The set positions of control valves for the air and waste gases are maintained or, alternatively, such control valves are positioned for operation during the next succeeding regenerative half period. A throttle valve may be positioned to maintain a relatively slight draught on the waste gas flue; however, valves for controlling the flow of regeneratively heated air and burnt gases may be positioned to stagnate the flow thereof.

6 Claims, 8 Drawing Figures

METHOD OF OPERATING A BATTERY OF COKE OVENS

BACKGROUND OF THE INVENTION

This invention relates to a method of operating a battery of coke ovens wherein during each regenerative change of draught on heating flues an interruption occurs to the supply of gas at a fixed rate into the flues formed by subdivisions in heating walls arranged alternately between coke oven chambers. More particularly, such a method of operation proceeds after first assuring uniform heating of the coking coal vertically along the heating walls by adjustment to the combustion in the heating flues and after adjusting control elements, such as curtains, dampers or the like, to control the operation of discrete heating flues in each heating wall to insure uniform heating of the coking coal lengthwise of the oven chambers and of discrete heating walls along the battery to insure uniform heating of all oven chambers.

Vertically uniform heating of the coking coal in oven chambers depends upon the shape of the flames rising in the heating flues. The flame shape may be affected by the heating gas and the combustion-supporting air which can be supplied at different levels in the flues. Control elements provided between the regenerator sole flue and the regenerator or disposed in the heating flues may be employed to control the differential heating in discrete heating flues associated with a single heating wall. This differential heating is necessary so as to compensate or allow for the narrowing of the oven chamber from coke side to machine side and for other factors which bring about different heat requirements lengthwise of the oven chamber. Uniform heating of all the heating walls can be achieved by the use of oven curtains between the waste heat valve and the waste heat flue.

These three forms of adjustment as enumerated above can be employed to insure uniform heating of the contents in all the oven chambers in a coke oven battery vertically along the height of the oven chambers and lengthwise of the oven chambers. However, such forms of adjustment once effected, insure uniform heating throughout only one particular carbonization time by each coke oven chamber. In other words, after the adjustments for uniform heating are made, the carbonization time for the contents in an oven chamber is fixed. All other things being equal.

A particular operating or coking time by the oven chambers in the battery is associated with a particular quantity of heating gas supplied per unit of time, i.e., a particular gas supply rate. If there is an appreciable change in the coking period, there is also a change not only in the quantity of gas to be supplied per unit of time, but also a change to the settings of control elements that control the inflow and discharge of gaseous media for the various flues in the heating walls. There is also a variation to the shape of the flame rising in the heating flues. A changeover to a different coking period for a battery is a difficult undertaking, requiring several weeks to complete. Such a changeover is based on changing the gas supply rate and adjusting the settings of the various control elements.

SUMMARY OF THE INVENTION

It is an object of the present invention to provide a simple solution to the problem hereinabove enumerated with regard to changing the coking time by the oven chamber in a battery of coke ovens.

It is a further object of the present invention to provide a method for operating a battery of coke oven chambers wherein heat consumption by the coking coal in the oven chambers is reduced during each regenerative half period only by interrupting the supply of gas at a pre-established uniform gas supply rate.

More specifically, the present invention provides a method of operating a battery of coke ovens with a regenerative change of draught on heating flues, the coke ovens including heating walls divided into rows of heating flues arranged alternately between coke oven chambers, the method including the steps of adjustably controlling the combustion of gases in the heating flues to insure the uniform heating of the coking coal vertically along the coke oven chambers, positioning control elements for the operation of discrete heating flues in each heating wall to insure uniform heating of the coking coal along the length of the heating walls for the coke oven chambers, selecting a gas supply rate for the delivery of gas per unit of time into the heating flues to define a carbonization time corresponding to a high output capacity of coke from the coke oven battery, and reducing heat consumption by the coking coal in the oven chambers during each regenerative half period by interruptions to the supply of gas at the selected gas supply rate.

Thus, in the method of operating a battery of coke ovens according to the present invention, adjustments are made to the coke oven battery to achieve a relatively short carbonization time, if possible, the shortest carbonization time feasible for continuous operation. Throughout the short carbonization time, operating conditions are such that the contents of all the coke oven chambers in the battery receive heat uniformly, both longitudinally and vertically of the oven chambers. If a longer carbonization time is required, the quantity of gas supplied per unit of time remains the same, namely, selected for the high coke output from the battery of oven chambers. The nature of heating by the heating flues and the position of control elements for adjusting heat distribution remains constant. However, interruptions or pauses to the combustion of gas are introduced within each regenerative half period as a means for dealing with a reduced heat consumption requirement.

The shape of the flame does not alter in the various heating flues during heating and heat is yielded in exactly the same way as previously in regard to coking chambers adjacent the heating flues, except during interruptions for a selected length of time during each regenerative half period.

In view of the considerable inertia distinctive of heat conductivity in refractory masonry, the relative heating values remain the same throughout the battery, notwithstanding the lower heating rate. Heating the coking coal takes longer but there is no alteration in the relative heating values for the coking coal in the oven chambers, both vertically and lengthwise of the chambers. In this way, coke production by the battery can be cut back in a relatively short time and then increased again. The gas supply rate, i.e., volume per unit of time, remains the same since the gas continues to be supplied at the same pressure and all the control elements remain in a common set position. In the method of the invention, all that needs to be done is to adjust the changeover or reversal facility for a longer or shorter interruption to the supply and removal of the gaseous media which support combustion.

Underlying the novel concept of the present invention is the realization that it is very important that the coking coal in the oven chambers undergo uniform carbonization vertically of the chambers. One way of insuring such vertically uniform heating to the oven contents is to burn the gases in the heating flues so as to distribute the flames evolving during combustion to provide this vertically uniform heating. Rich gases, of course, have a short flame and lean gases have a long flame. In previous endeavors directed to achieving very uniform vertical heat distribution, either the combustion-supporting air or the gas or both have been supplied to the heating flues at vertically-spaced intervals. Unfortunately, this endeavor requires a relatively complicated construction of parts for supplying the gaseous combustion-supporting agents. To lengthen the short flame when burning rich gases, a leaner gas or inert ingredients have been added to reduce the caloric value of the rich gas. An example of this form of coke oven heating is the recirculation-type of coke oven in which waste gases are admixed with the combustion-supporting gases before and during combustion. However, a special construction of parts is necessary to return the waste gas to the heating flues.

It is preferred, according to the method of the present invention, to deliver the gas into the heating flues at a greater supply rate than the selected gas supply rate at which combustion throughout non-interrupted regenerative half periods yields sufficient heat to achieve a predetermined or high output capacity of coke. In this event, the procedure of reducing heat consumption includes interrupting the supply of gas at the greater supply rate to uniformly carbonize the coking coal in the oven chambers within the predetermined or desired carbonization time. Thus, according to this further aspect of the method of the present invention, the operation of a battery of regeneratively-heated coke ovens remains in a relatively simplified manner by selecting an increased gas supply rate over that as compared with the gas supply rate for coke oven operations at a high coke output wherein sufficient heat is liberated to achieve the predetermined carbonization time by continuous heating throughout all the regenerative half periods. When such an increased gas supply rate is selected, then within each regenerative half period, there is an interruption or pause to the heating duration while assuring that the coking coal content in the oven chambers undergoes uniform carbonization within a required carbonization time. In this further aspect of the invention, the total amount of gas and heat supplied to the oven masonry remains the same as the amount of gas and heat supplied to achieve carbonization times using continuous heating throughout regenerative half periods.

Let it be assumed, for example, that 9 $Nm^3/h$ of gas are supplied to each of the heating flues on a continuous heating basis for a carbonization time of 25 hours in each of the oven chambers and a reversal time of 20 minutes which represents the regenerative half period. If there is an interruption of 8 minutes to the regenerative half period whereby each heating flue is heated for only 12 minutes, then the quantity of heat supplied during the 12 minutes is given by the following expression:

$$\frac{20 \text{ min.}}{12 \text{ min.}} \times 9\ Nm^3h = 15\ Nm^3h.$$

As a further example, if the pause or interruption has a duration of 10 minutes so that the duration to heating time is 10 minutes, the quantity of gas supplied per unit of time is given by the following expression:

$$\frac{20 \text{ min.}}{10 \text{ min.}} \times 9\ Nm^3h = 18\ Nm^3h.$$

The flame length is much greater in the latter example than in the former example, while the top parts of the oven chambers are heated in a satisfactory manner. To effect the pause during each regenerative half period, a gas supply valve must be first closed. There are several ways of devising or controlling the pause or interruption in heating.

In one such manner, the air valves and waste gas valves remain open after closure of the gas supply valves. Air continues to flow throughout the heating system and it must be borne in mind that the increased air velocity through the heating system removes some heat from the oven masonry.

Instead of leaving the air and waste gas valves in their open position, namely, the position in which they are located during the existing regenerative half period, the valves can be repositioned at the beginning of the heating pause after closure of the gas valve so that entry of air and the flow thereof through the heating elements is in the opposite direction which is, in other words, the direction in which the heating flues will be heated in the next regenerative half period.

A reduction to possible heat loss during the interruption or pause to heating during a regenerative half period may be achieved by restricting the flow of air through the heating system when the air valves are open. To restrict the air flow, a throttle valve in the line interconnecting the waste-gas flue with the chimney is moved into a position to reduce the suction or draught in the waste-gas flue. The air valves are still open, but the air enters at a reduced quantity and flows through one group of generators into the heating flues and then through another group of regenerators to the waste-gas flue. This small residual flow in the heating system has the advantage of insuring that the pressure within the various heating elements remains at clearly-defined conditions and there is no impairment of thermal efficiency.

The aforementioned throttle between the waste-gas flue and the chimney can be a waste-gas throttle valve of the type conventionally used in this position as a control element to maintain a constant draught on the waste-gas flue irrespective of factors altering chimney draught.

In a coke oven battery of the type wherein media for preheating is supplied from one side of the battery through regenerator sole flues and the burnt gases are removed at the other side of the battery through adjacent regenerator sole flues, the interruption or pause in heating during a regenerative half period is brought about by closing gas valves and relocating the valves used to control the air and waste-gas into central positions. In this type of coke oven battery, there is no circulation of gaseous media through the regenerators and heating flues and, therefore, the gases become stagnated.

To effect a transition from a form of operation wherein the heating flues are heated continuously throughout each regenerative half period to a method of operation according to the present invention, the pressure in the gas distribution lines is increased in accordance with the increased supply per unit of time of gas to the burners and the reversal facility is correspondingly changed over or reversed.

When a transition is made to the method of operation according to the present invention, there is considerable reduction to vertical flue temperature differences in the change, whereby the end coke product is carbonized uniformly along the vertical height of the coking chambers. By increasing the quantity of gas supplied per unit of time and then compensating for the otherwise increased heat input by means of an interruption or pause during each regenerative half period, a short carbonization period is achieved and a relatively low maximum masonry temperature is also achieved.

These features and advantages of the present invention as well as others will be more fully understood when the following description is read in light of the accompanying drawings, in which.

Figure 1:
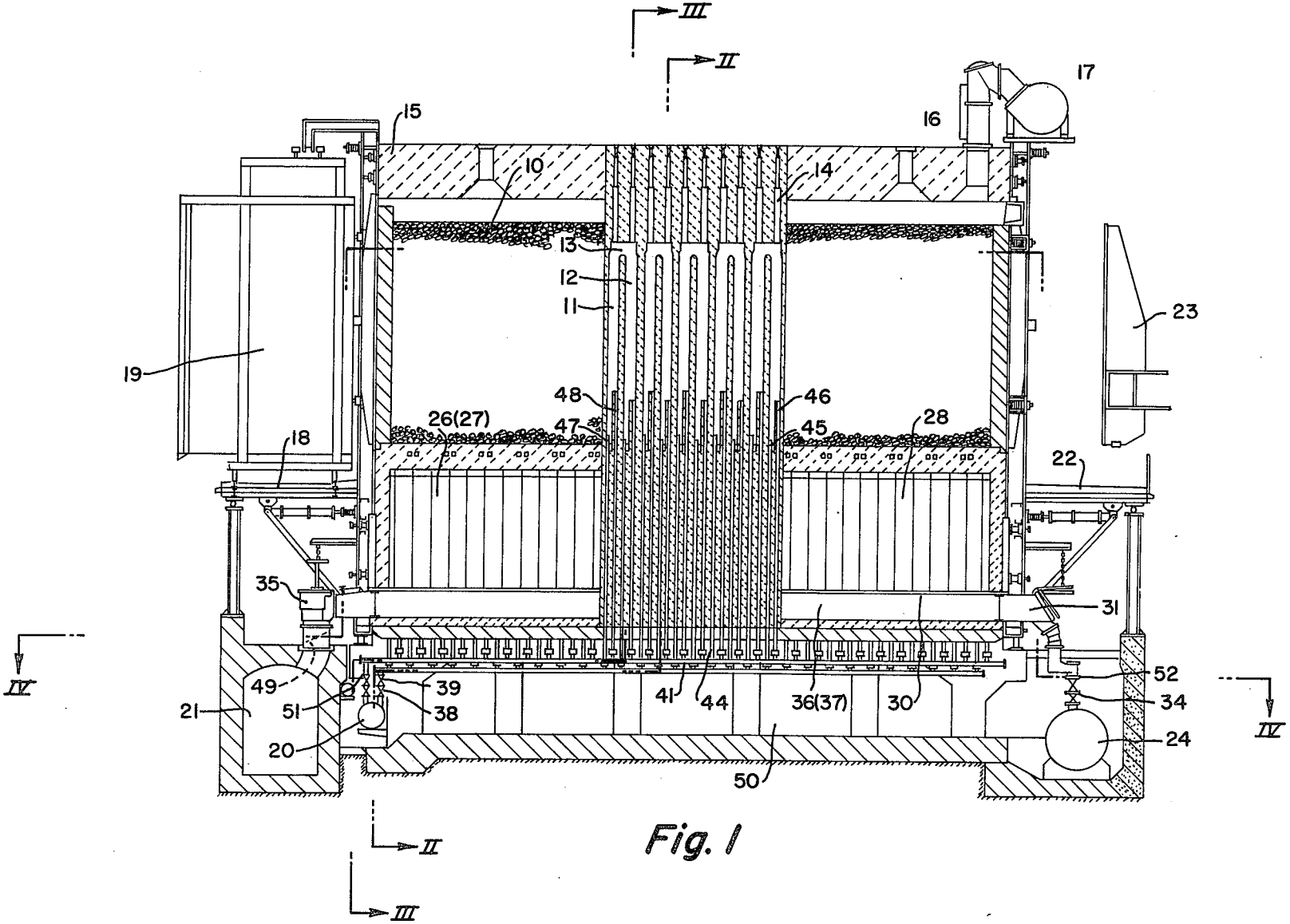
FIG. 1 is an elevational view partly in section through a row of heating flues and partly in section through a coke oven chamber.
Figure 4:
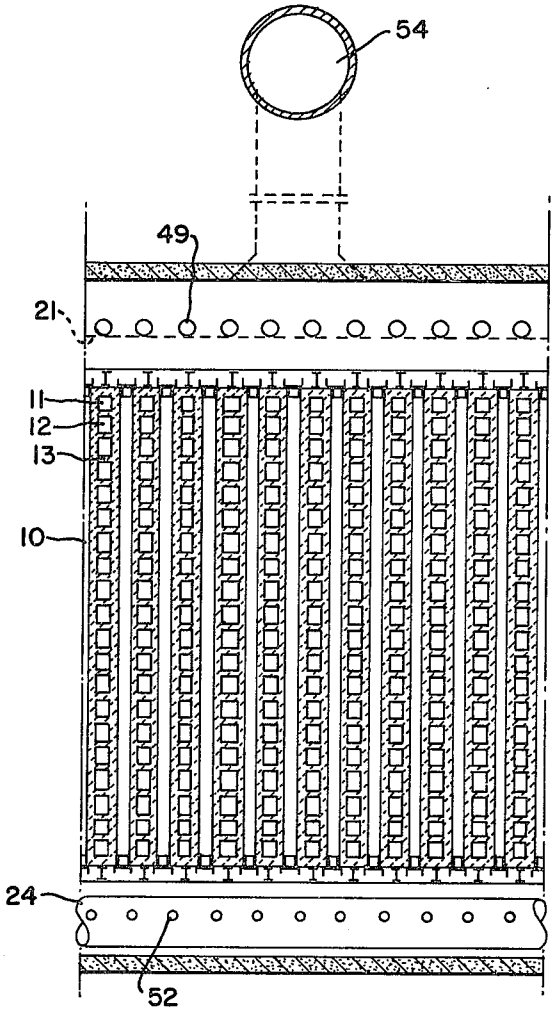
FIG. 4 is a sectional plan view taken along line IV—IV of FIG. 1.

As shown in FIGS. 1–4, a battery of coke ovens includes horizontal coke oven chamber 10 extending alternately between rows of heating flues 11 and 12. The heating flues are defined in the heating walls between the coke oven chambers. In each heating wall, the heating flues are in the form of twin-flues formed by crosswalls which define the up-burning flue 11 connected to the down-burning flue 12 by a top aperture 13. The direction of burning is reversed when the direction of draught on the flues is reversed at regenerative half periods or regular intervals of, for example, 20 or 30 minutes. Inspection holes in the oven crown 15 are used for observing the operation and combustion in the heating flues. Coking coal is introduced through charging holes 16 in the oven crown. The gases liberated during the carbonization process of the coking coal in the oven chambers are delivered by ascension pipes to a collecting main 17 extending along the coke oven battery.

A charging floor 18 (FIG. 1) extends along the coke side of the battery for supporting a coke-guide machine 19. The coke-guide machine supports coke guides, a door handling machine, a door cleaner and a door frame cleaner. A rich-gas distribution main 20 and a collector flue 21 for flue gas also extend along the coke oven battery at the coke side.

A ram head 23 of a coke pushing ram is driven by a coke pushing machine which is movable along the charging floor 22 at the machine side of the coke oven battery. A lean-gas distribution main 24 extends along the coke oven battery at the machine side.

Figure 3:
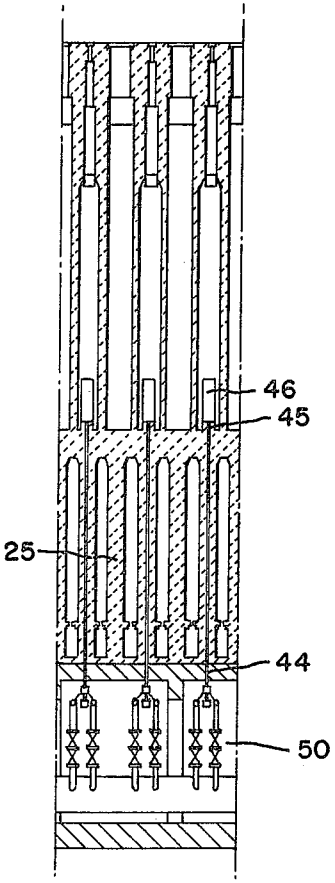
FIG. 3 is a sectional view taken along line III—III of FIG. 1.
Figure 2:
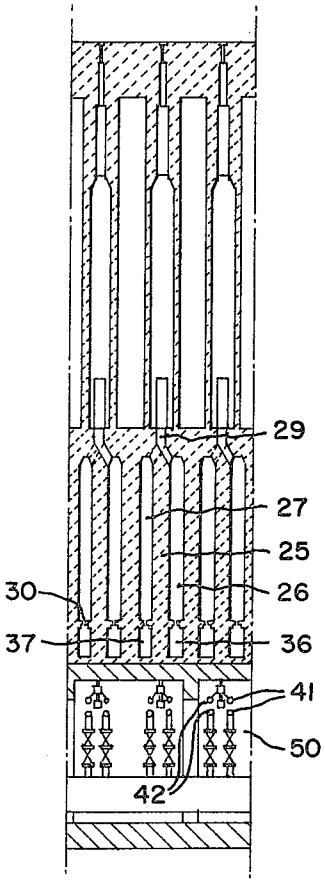
FIG. 2 is a sectional view taken along line II—II of FIG. 1.
Figure 8:
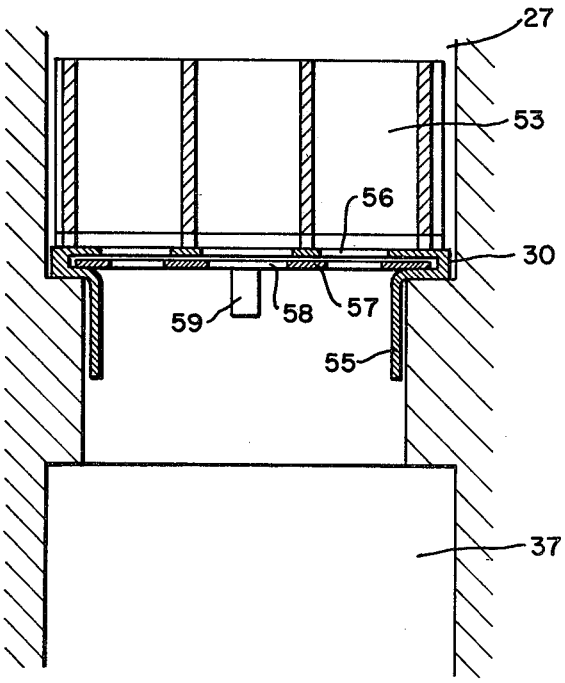
FIG. 8 is an enlarged view of flow control plates for a regenerator at the sole flue.

Regenerator partitions 25 are disposed below the coke oven chambers. A pair of regenerators 26 and 27, connected to the regenerator sole flues 36 and 37, is disposed between each of the vertical central planes of the oven chambers. Crosswalls 28 subdivide the regenerators 26 and 27 into individual cells. As shown in FIGS. 2 and 3, each regenerator cell is connected to a heating flue in a row thereof disposed at the left side of the regenerator cell and a heating flue in a row disposed at the right side of the regenerator cell. A control member 30 is disposed in each of the openings provided between a regenerator sole flue 36 or 37 and one of the cells of the regenerator 26 or 27. The details of the construction of the control members 30 are shown in FIG. 8. The control members 30 shown therein extend below the bottom checkerbrick 53 of a regenerator cell. The control member includes a metal frame 55 having lateral bars bearing against the walls of the regenerator sole flue 36 or 37. The top plate of frame 55 includes apertures 56. These apertures can be closed to a desired extent by a damper plate 57 which has corresponding apertures 58. The damper plate 57 can be adjusted longitudinally of the sole flue by means of a pin 59. This form of control element is shown in U.S. Pat. No. 3,969,191 which is assigned to the same Assignee as the present invention. However, other forms of control elements may be employed.

When a pair of regenerators 26 and 27 receives gas along its entire length in an ascending direction, the two adjacent pairs of regenerators 26 and 27 receive gas in a downward direction. In this type of connection between individual regenerator cells with flues of two adjacent rows of heating flues, it follows that if in one heating flue row, the first flue burns upwards and the second flue burns downwards, the direction of flow is reversed in the two adjacent heating flues, i.e., in the successive heating flue rows the succession of upwardly and downwardly burning heat flues alternate from row-to-row.

When the coke oven battery is operated on rich oven gas, the two regenerators 26 and 27 are alternately used for preheating the combustion-supporting air and for absorbing the heat from the burnt gases discharged from the flues. When the coke oven battery is operated for heating by lean gas, the regenerators 26 and 27 are used for alternately preheating the lean gas.

Figure 6:
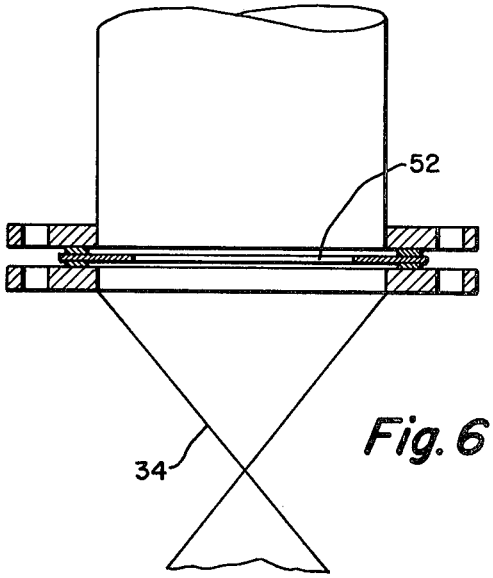
FIG. 6 is an enlarged view of an oven curtain in a lean-gas feed line for a regenerator sole flue.

Air is supplied to the regenerator sole flues 36 and 37 by air slides 31 actuated by a reversing winch disposed at the end of the regenerator sole flues. The regenerator sole flue 36 includes a lean-gas feed connected to a lean-gas distribution main 24 by valves 34 actuated by the reversing winch. Associated with valves 34 are oven curtains 52 as shown in FIG. 6. The regenerator sole flues 37 have only one air feed slide 31. At the coke side of the coke oven battery, all the regenerator sole flues 36 and 37 are connected by waste-gas heat valves to the flue gas collecting main 21.

Figure 5:
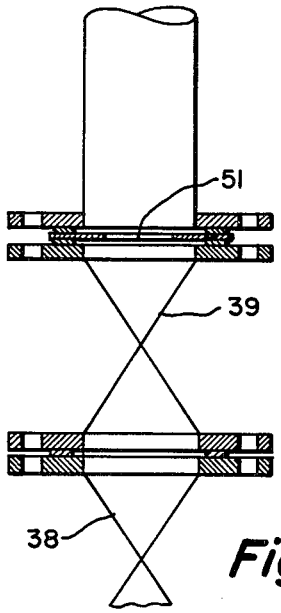
FIG. 5 is an enlarged view of an oven curtain in a rich-gas feed line for a nozzle tube.
Figure 7:
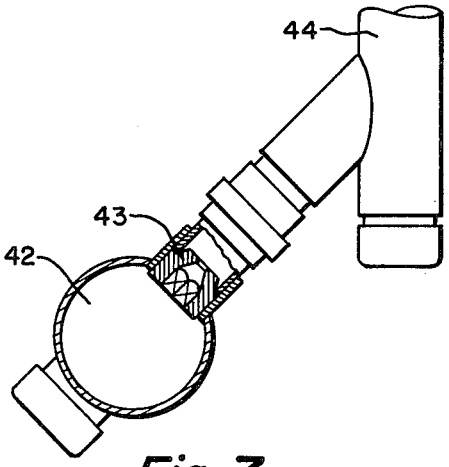
FIG. 7 is a view of a nozzle tube in an ascension pipe for rich gas.

Rich gas is supplied from the rich-gas distribution main 20 through check valves 38, reversing valves 39 and oven curtains 51 which are shown in FIGS. 1 and 5 and employed to control the individual pipe strand through nozzle pipes 41 and 42 that extend along the basement 50. The pipes 41 receive rich gas during one regenerative half period and pipes 42 receive rich gas during the other regenerative half period. As shown in FIG. 7, calibrated nozzles 43 control the flow rate of rich gas from pipes 41 and 42 into ascension pipes 44 which extend along in regenerator partitions 25 to nozzles 45, 46, 47 and 48. The nozzles 45–48 extend upwardly to varying heights within the heating flues 11 and 12 as shown in FIG. 1.

Throttle valves 49 are disposed between the waste-heat valves 35 and the flue gas collecting main 21. These throttle valves provide the means by which the chimney draught on the gas collecting main 21 is distributed to the individual regenerator sole flues.

To obtain uniform heating of all the coke oven chambers in the battery, even with a short coking time and high heating flue temperatures when heating is achieved by rich gas, air slides 31 must be first adjusted and then adjustments to valves 34 for controlling the supply of lean gas, and adjustments to control members 30 are effected. As pointed out previously, the control members 30 are disposed between the regenerator sole flues 36 and 37 and the individual cells of the lean gas regenerators 26 and the air regenerators 27. As can be readily understood in light of the foregoing, the control members 30 are operative for metering both upward and downward burning of the gaseous media. This media enters from the two adjacent regenerator cells of the regenerators 26 and 27 in which the media to be preheated rises. The media then enters the heating flue of an adjacent heating flue row. The burnt gases pass downwardly in a regenerator cell of an adjacent pair of regenerators 26 and 27 and then under the influence of control members 30 the burnt gases enter a pair of regenerator sole flues 36 and 37 and then these gases enter the flue gas collecting main 21 when the waste-heat valve 35 is open. The throttle valves 49 disposed between the waste-heat valve 35 and the flue gas collecting main 21 must also be correctly or properly adjusted. When there is a lengthening to the desired coking time, then without employing the method of the present invention suitable adjustments must be undertaken to all the control members as an attempt to control as far as possible heating of the coking coal in all oven chambers in both the vertical and longitudinal directions while the quantity of gas supplied to the heating flues must be reduced. This is difficult and becomes a momentous undertaking. To alleviate this, the concept of the present invention is to retain the quantity of gas supplied per unit of time to the heating flues, but to interpose within each regenerative half period, a pause of a length of time such that the heating flue temperatures are reduced and the duration extended until the coking coal in the coking chambers is completely carbonized or coked.

The same condition applies when heating with rich gas. In this case, with the supply of a predetermined quantity of rich gas per unit of time for a short coking time, the rich gas is distributed to the nozzle pipes 45–48 by adjustment of (1) the oven curtains 51, (2) the calibrated nozzles 43, (3) the air slides 31, (4) the control members 30 between the regenerator sole flues 36 and 37 and the cell of the regenerators 26 and 27, and (5) the throttle valves 49 interconnecting between the waste-heat valves 35 and the flue gas collecting main 21. Moreover, in this case, when a longer coking time is adopted, the amount of rich gas supplied per unit of time or, in other words, the rich gas supply rate remains the same, but a pause is interposed between each regenerative half period of a length of time such that the duration until the coking coal in the oven chambers is completely coked is extended to the same extent in all chambers of the coke oven battery.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A method of operating a battery of coke ovens with a regenerative change of draught on heating flues, the coke ovens including heating walls divided into rows of heating flues arranged alternately between coke oven chambers, said method including the steps of:

establishing a relatively short carbonization time for a high and approximately maximum coke output capacity throughout a continuous coking operation by each coke oven chamber by the steps of:

(a) setting control elements into fixed positions to establish controlled flows of gaseous media in conduits coupled to the heating flues to distribute the flame evolving during combustion within the heating flues for insuring vertically uniform heating of the coking coal within each coke oven chamber;

(b) setting other control elements into fixed positions to establish controlled flows of gaseous media in conduits coupled to the discrete heating flues to distribute combustion media for insuring horizontally uniform heating of coking coal within each coke oven chamber along the length of the heating walls therefor; and (c) using control elements to produce a selected gas supply rate for the delivery of gas into said heating flues to define at least said relatively short carbonization time; delivering gas always at the selected gas supply rate into the heating flues for combustion during each regenerative half cycle, delivering gaseous media while controlled by the fixed positions of said control elements into the heating flues for supporting combustion during each regenerative half cycle, and interrupting the supply of gas into the rows of heating flues for each coking chamber during each and every regenerative half cycle for a preselected duration of time to obtain a predetermined desired coking time by each coking chamber which coking time is greater than said relatively short carbonization time.

2. The method according to claim 1 wherein said step of using control elements to produce a gas supply rate is further defined to include using such control elements to maintain a selected gas supply which is greater than a gas supply yielding sufficient heat upon combustion to achieve said relatively short carbonization time by any given coking chamber.

3. The method according to claim 1 wherein said battery of coke ovens includes horizontal coking chambers and vertical heating flues, and wherein said interrupting the supply of gas includes closing valves to interrupt the supply of gas to the heating flues while maintaining set positions of control valves for air and waste gases.

4. The method according to claim 1 wherein said battery of coke ovens includes horizontal coking chambers and vertical heating flues, and wherein said interrupting the supply of gas includes closing valves to interrupt the supply of gas to the heating flues and adjusting control valves for air and waste gases into positions for operation during the next regenerative half period.

5. The method according to claim 1 wherein said battery of coke ovens includes horizontal coking chambers and vertical heating flues, and wherein said interrupting the supply of gas includes closing valves to interrupt the supply of gas to the heating flues, and thereafter positioning a throttle valve connected between a waste-gas flue and a chimney to maintain only a relatively slight draught on the waste-gas flue.

6. The method according to claim 1 wherein said battery of coke ovens includes horizontal coking chambers and vertical heating flues, and wherein media for preheating in the regenerators is supplied from one side of said battery of coke ovens and the burnt gases are removed from the other side of said battery of coke ovens, and wherein said interrupting the supply of gas includes closing valves to interrupt the supply of gas to the heating flues, and positioning into central locations valves for controlling the flow of said media and burnt gases to stagnate the flow thereof.

* * * * *